United States Patent [19]

Kirkpatrick et al.

[11] 4,345,504

[45] Aug. 24, 1982

[54] GUN MOUNT

[75] Inventors: Robert G. Kirkpatrick, Shelburne; Ronald R. Snyder, Georgia, both of Vt.

[73] Assignee: General Electric Company, Burlington, Vt.

[21] Appl. No.: 138,473

[22] Filed: Apr. 8, 1980

[51] Int. Cl.[3] ..... F41D 11/24

[52] U.S. Cl. ..... 89/37 GM; 89/12

[58] Field of Search ..... 89/12, 37 R, 37 B, 37 E, 89/37 GM, 44 R

[56] References Cited

U.S. PATENT DOCUMENTS

| | | | |
|---|---|---|---|
| 725,503 | 4/1903 | Strauss | 89/37 E |
| 811,540 | 2/1906 | Bayne | 89/37 E |
| 2,898,811 | 8/1959 | Helble | 89/37 R |
| 4,121,496 | 10/1978 | Clayson | 89/37.5 R |
| 4,179,978 | 12/1979 | Kirkpatrick et al. | 89/12 |
| 4,183,510 | 1/1980 | Kontis | 89/44 R |

OTHER PUBLICATIONS

U.S. Air Force T.O. 11W1-12-4-34, FIG. 2, Apr. 15, 1965.

20 mm Weapons Application Data, FIG. 4, G.E. Co., MPB-438(1000)466.

Final Summary Report, Model D. Vulcan M71 (T171E3) and T171E2 20 mm Automatic Gun, pp. 5-30 through 5-38, Jul. 31, 1959.

*Primary Examiner*—Stephen C. Bentley

*Attorney, Agent, or Firm*—Bailin L. Kuch

[57] ABSTRACT

A feature of this invention is the provision of a mount for a Gatling type gun having a muzzle clamp which is journaled for rotation in a reciprocable mass and which reciprocable mass is journaled for longitudinal reciprocation with respect to stationary support guides. Additionally, the housing is coupled to the support structure by a combination of a recoil adapter and a rigid guide, one end of the adapter and one end of the guide having a common transverse attachment to the support structure, the other end of the adapter having a pivot to the housing which is journaled for longitudinal reciprocation to the guide. This arrangement increases the recoiling mass without significantly increasing the total weight, precludes bending of the recoil adapters, and reduces frictional interferences.

5 Claims, 3 Drawing Figures

GUN MOUNT

BACKGROUND OF THE INVENTION

1. Field of the Invention

This invention relates to a mount for a gun having a revolving battery of barrels, e.g., a Gatling type gun.

2. Prior Art

The most conventional arrangement for mounting Gatling type guns is shown in U.S. Air Force T.O. 11W112-4-34, FIG. 2, dated Apr. 15, 1965, showing the M61A1 gun. The gun has two recoil adapters coupling the forward end of the gun housing to the stationary support structure, and a sliding guide fitting integral with the back plate of the gun, to couple the aft end of the gun housing to the stationary support structure. This is also shown in "20 mm Weapons Application Data" FIG. 4, GE Co., MPB-438(1000)466. An alternative arrangement is shown in U.S. Pat. No. 2,898,811 issued to D. R. Helble on Aug. 11, 1959, probably showing a variant of the M61 gun. The gun has two recoil adapters coupling the forward end of the gun housing to the stationary support structure, and a rotating assembly coupling the forward end of the barrel cluster to the stationary structure. The muzzle clamp is free to slide longitudinally within a ball bearing ring assembly which is fixed to the stationary support structure. U.S. Pat. No. 4,121,496 issued to A. E. Clayson on Oct. 24, 1978 also shows a muzzle clamp sleeve which is free to slide longitudinally within a ball bearing ring assembly which is fixed to the stationary support structure. U.S. Pat. No. 4,179,978 issued to R. G. Kirkpatrick et al on Dec. 25, 1979 shows an aft barrel clamp having a plurality of rollers, each journaled on an axis parallel to the gun longitudinal axis and free to rotate about the gun longitudinal axis and to slide longitudinally against a raceway which is fixed to the stationary support structure.

In these barrel clamp arrangements, high vertical or horizontal forces, depending on the attitude of the gun mounting, are imparted to the barrel clamp mount from the gun firing forces. These forces cause frictional interferences, which adversely affect the ability of the gun to repeat in travel, i.e., the ability of the recoil adapter to respond repetitively, thus adversely affecting the dispersion of the fired rounds of ammunition and the gun operation.

SUMMARY OF THE INVENTION

It is an object of this invention to provide a barrel clamp forward mount for a Gatling type gun which minimizes the frictional interferences caused by gun firing forces.

Another object is to provide a barrel clamp forward mount which will decrease recoil loads and travel by increasing the recoil mass without increasing frictional interferences.

A feature of this invention is the provision of a mount for a Gatling type gun having a muzzle clamp which is journaled for rotation in a reciprocable mass and which reciprocable mass is journaled for longitudinal reciprocation with respect to stationary support guides. Additionally, the housing is coupled to the support structure by a combination of a recoil adapter and a rigid guide, one end of the adapter and one end of the guide having a common transverse attachment to the support structure, the other end of the adapter having a pivot to the housing which is journaled for longitudinal reciprocation to the guide. This arrangement increases the recoiling mass without significantly increasing the total weight, precludes bending of the recoil adapters, and reduces frictional interferences.

BRIEF DESCRIPTION OF THE DRAWING

These and other objects, features and advantages of the invention will be apparent from the following specification thereof taken in conjunction with the accompanying drawings in which.

DESCRIPTION OF THE INVENTION

Figure 1:
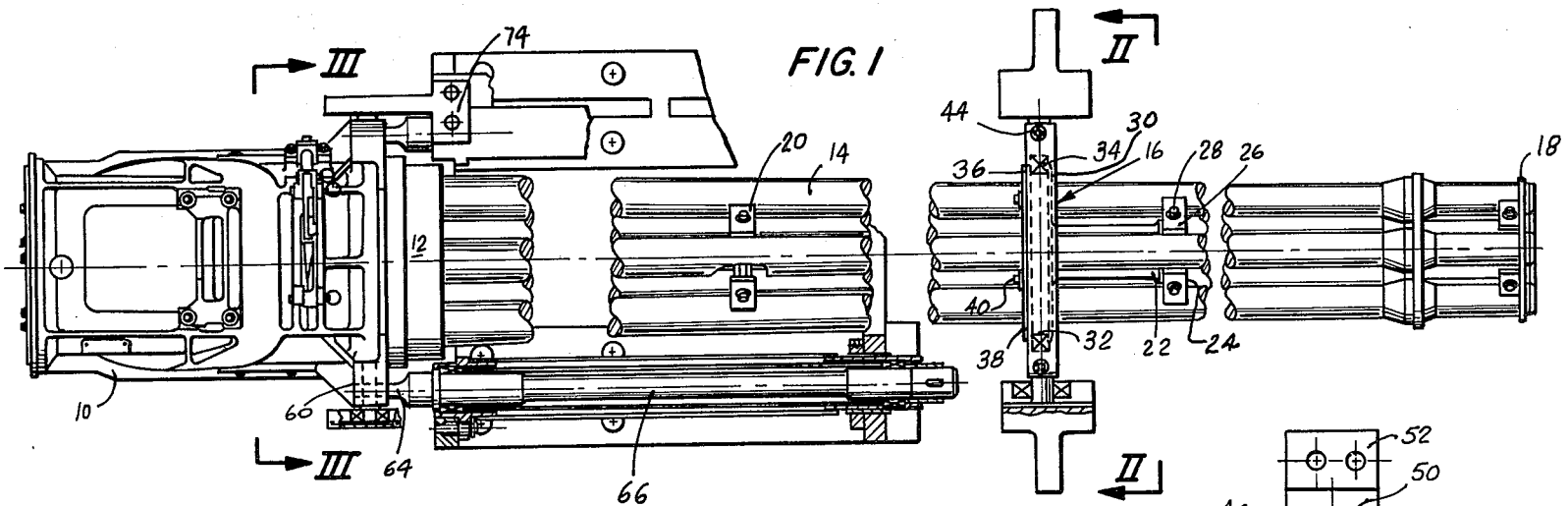
FIG. 1 is a top view of Gatling type gun embodying this invention.

A Gatling type gun is shown in FIG. 1 having a stationary housing 10 in which is journaled a rotor 12. A plurality of gun barrels 14 are respectively secured into bores in the rotor by interrupted threads. A mid-barrel clamp assembly 16, a muzzle clamp assembly 18 and an aft clamp assembly 20 are provided along the length of the barrel cluster. The muzzle and aft clamp assemblies are of the type shown in FIG. 4 of U.S. Pat. No. 4,179,978, supra.

Figure 2:
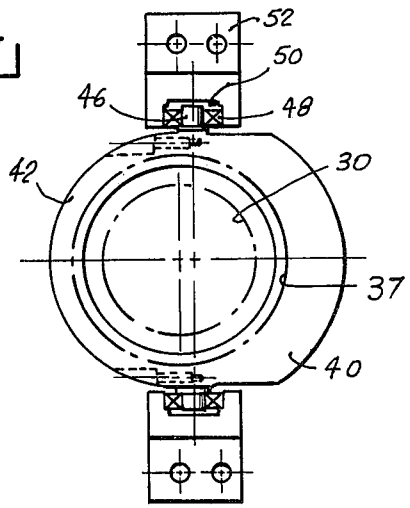
FIG. 2 is a transverse view in cross-section taken along plane II—II of FIG. 1.
Figure 3:
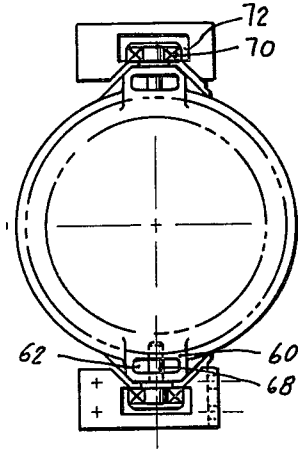
FIG. 3 is a transverse view in cross-section taken along plane III—III of FIG. 1.

The mid-barrel clamp assembly 16 is an improvement on that shown in FIG. 2 of U.S. Pat. No. 4,179,978. The assembly includes a medial, cylindrical portion 22 having a distal, forward, flange portion 24 having a plurality of peripheral cut-outs, in an annular row each of which receives a respective gun barrel 14. The barrel is clamped in the cut-out by a clamp-plate 26 and bolt 28. The portion 22 also has a distal, aft, flange portion 30 which has a like plurality of longitudinal bores in an annular row, each of which passes a respective gun barrel. The flange portion 30 has a peripheral surface 32 to receive the inner race of a ball bearing assembly 34. The bearing assembly is captured to the flange portion by and between a forward annular shoulder rim 36 projecting from the flange portion and an aft circular plate 38, having a plurality of holes to pass the gun barrels, which is fixed to the flange portion by a plurality of bolts 40.

The outer race of the bearing assembly 34 is captured in an inner annular groove 37 in a reciprocable mass. The mass includes a lower portion 40 having a semicircular opening to receive one half of the outer race, and an upper portion 42 having a semicircular opening to receive the remaining one-half of the outer race. The two portions are clamped together about the outer race by two bolts 44.

The lower portion 40 has a diametrical pair of stub shafts 46. A respective ball bearing roller 48 is captured to each shaft. Each roller 48 rides in a respective longitudinally extending channel 50 in a respective bracket 52 which is fixed to the ground support, e.g., a vehicle bulkhead.

By this arrangement the clamped together cluster of barrels is free to rotate with minimal friction, within the reciprocable mass, while this mass is free to reciprocate with minimal friction in the stationary brackets 52. This reciprocable mass is part of the total recoiling mass of the gun. The increase in the recoiling mass provided by this mass provides a reduction in the recoil travel and the recoil loads of the gun. The combination of the bearing 48 in the groove 50 provides a frictionless accommodation to changes in the relative length of the gun due to thermal expansion or bending, without any adverse effect on gun function. The two part split reciprocable mass permits convenient removal of the gun from this forward mount.

The housing 10 of the gun has two diametrically spaced apart ears 60, each of which has a slot 62 to receive the respective aft end 64 of a spindle of a recoil adapter 66. The adapter may be of the type shown in "Final Summary Report, Model D, Vulcan M61 (T171E3) and T171E2 20 mm Automatic Guns, pp. 5–30 through 5–38, July 31, 1959, Contract DA-30-115-ORD-1," or in U.S. Pat. No. 4,183,510 issued to G. E. Kontis on Jan. 15, 1980. A pin 68 is inserted into each ear, through a transverse bore in the spindle end 64 to pivotally couple the aft end of the spindle to the gun housing. The forward end of the housing of the recoil adapter is bolted to the support structure. A respective bearing 70 is mounted to each of the pins 68. The bearing 70 rides in a channel element fixed 72 formed in a plate 74 which is bolted to the support structure. The bearing 70 permits longitudinal movement of the gun housing and the spindle of the recoil adapter but prevents transverse movement, thereby precluding any bending movement on the spindles and the spindle bushings in the recoil adapters.

We claim:

1. A gun comprising:

a housing;

a rotor having a plurality of gun barrels journaled for rotation about a longitudinal axis with respect to said housing;

clamp means secured to said plurality of gun barrels;

ring mass means having a longitudinal bore therein;

first antifriction bearing means journaling said clamp means for rotation with respect to said ring mass means about said longitudinal axis;

first stationary support means;

second antifriction bearing means journaling said ring mass means to said first stationary support means for displacement along said longitudinal axis of said first antifriction bearing means and said ring mass means with respect to said first stationary support means.

2. A gun according to claim 1 further including:

second stationary support means;

an elongated cylindrical recoil adapter having two extremities, one of said extremities being fixed to said second stationary support means; the other of said extremities being fixed to said housing;

third stationary support means;

third antifriction bearing means journaling said housing to said third stationary support means for longitudinal displacement with respect to said third stationary support means;

having a mode of operation such that said second and third stationary support means in combination permit said recoil adapter to undergo longitudinal displacement and preclude angular or bending displacement.

3. A gun according to claim 2 wherein:

said first antifriction means is an annular ball bearing assembly.

4. A gun according to claim 3 wherein:

said second antifriction means is a ball bearing assembly operating in a channel in said second stationary support means.

5. A gun according to claim 4 wherein:

said third antifriction means is a ball bearing assembly operating in a channel in said third stationary support means.

* * * * *

UNITED STATES PATENT AND TRADEMARK OFFICE

CERTIFICATE OF CORRECTION

PATENT NO. : 4,345,504

DATED : August 24, 1982

INVENTOR(S) : Robert G. Kirkpatrick et al.

It is certified that error appears in the above-identified patent and that said Letters Patent are hereby corrected as shown below:

Column 3, line 23, change "element fixed 72 formed" to -- element 72 fixed--.

Signed and Sealed this

Third Day of May 1983

[SEAL]

*Attest:*

GERALD J. MOSSINGHOFF

*Attesting Officer*

*Commissioner of Patents and Trademarks*